US007003232B2

(12) United States Patent
Komori

(10) Patent No.: US 7,003,232 B2
(45) Date of Patent: Feb. 21, 2006

(54) OUTPUT TIMING CONTROLLED IMAGE FORMING APPARATUS, SYSTEM AND METHOD

(75) Inventor: Takumi Komori, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/641,075

(22) Filed: Aug. 15, 2003

(65) Prior Publication Data

US 2004/0105688 A1 Jun. 3, 2004

(30) Foreign Application Priority Data

Aug. 19, 2002 (JP) ..... 2002-238376

(51) Int. Cl.
*G03G 15/00* (2006.01)

(52) U.S. Cl. ..... 399/8; 399/75; 399/77

(58) Field of Classification Search ..... 399/2, 399/8, 9, 75–78, 82, 83, 85
See application file for complete search history.

(56) References Cited

U.S. PATENT DOCUMENTS 5,809,363 A * 9/1998 Kitamura et al. ..... 399/8
5,915,148 A * 6/1999 Hamaguchi et al. ..... 399/77
6,031,631 A * 2/2000 Tahara et al. ..... 399/2
6,192,202 B1 * 2/2001 Doi ..... 399/8
6,625,406 B1 * 9/2003 Suzuki et al. ..... 399/75

FOREIGN PATENT DOCUMENTS

JP 9-83696 3/1997

* cited by examiner

*Primary Examiner*—William J. Royer
(74) *Attorney, Agent, or Firm*—Oblon, Spivak, McClelland, Maier & Neustadt, P.C.

(57) ABSTRACT

An image forming system includes a plurality of image forming apparatuses which are connected to each other via a communication line. Each of the image forming apparatuses includes an image reader that reads an image of an original document as image data; an image data storage that stores the image data; an image forming unit that forms an image onto a sheet of paper from the image data; and a communication unit that transmits and receives any one of the image data and control data for controlling an image forming operation. At least one of the image forming apparatuses includes an output timing controller that controls the plurality of image forming apparatuses so that start time of an image forming operation are different among the plurality of image forming apparatuses.

20 Claims, 10 Drawing Sheets

OUTPUT TIMING CONTROLLED IMAGE FORMING APPARATUS, SYSTEM AND METHOD

BACKGROUND OF THE INVENTION

1) Field of the Invention

The present invention relates to an image forming apparatus, an image forming system, and an image forming operation control method, which can reduce peak power consumption when a plurality of image forming apparatus, which are connected to each other via a communication line, work in parallel.

2) Description of the Related Art

Sometimes many image forming apparatuses, which may be copying machines, are connected to each other via a communication line to form an image forming system. All the image forming apparatuses operate in parallel so that images can be formed at high-speed and in large quantity. Thus, such an image forming system increases productivity.

Japanese Patent Application Laid-open Publication No. H9-83696 discloses a conventional technique. The user requests a copy job from a master copying machine to a slave copying machine remote from the master copying machine. The master copying machine displays, on its display unit, identifiers of slave copying machines and paper sizes provided by each slave copying machine, so as to allow the user to select the slave copying machine to be requested.

However, since such image forming apparatuses start operation at the same time, the power consumption rises instantaneously. Particularly, the power consumption is the maximum at the time of starting and finishing printing, because, the parts are started and stopped to be driven at these timings. When all the image forming apparatuses start operation at the same time, it gives a great burden on the electric power infrastructure of, for example, the building in which the image forming system is installed.

One approach is to connect the slave copying machines in a daisy chain. Because of the daisy chain, the instructions, which is are sent by the master copying machine to the slave copying machines, to start the operation, is automatically delayed. However, since the delay is very small, and the operating speeds of the devices have increased considerably as the technology has advanced, the slave copying machines start the operation almost simultaneously. Thus, the daisy chain is also not a solution to the problem.

SUMMARY OF THE INVENTION

It is an object of the present invention to at least solve the problems in the conventional technology.

The image forming apparatus according to one aspect of the present invention is connected to another image forming apparatus via a communication line. The image forming apparatus includes a communication unit that transmits and receives any one of image data and control data for controlling an image forming operation, to and from the another image forming apparatus; and an output timing controller that generates a timing control signal indicating that a start time of an image forming operation is different between the image forming apparatus and the another image forming apparatus.

The image forming system according to another aspect of the present invention includes a plurality of image forming apparatuses which are connected to each other via a communication line, wherein each of the image forming apparatuses includes a communication unit that transmits and receives any one of image data and control data for controlling an image forming operation, to and from other image forming apparatuses, and at least one of the image forming apparatuses includes an output timing controller that controls the plurality of image forming apparatuses so that a start time of an image forming operation is different among the plurality of image forming apparatuses.

The image forming operation control method according to still another aspect of the present invention is for controlling a plurality of image forming apparatuses which are connected to a communication line. The image forming operation control method includes allowing the plurality of image forming apparatuses to start an image forming operation at a different time among the plurality of image forming apparatuses.

The other objects, features and advantages of the present invention are specifically set forth in or will become apparent from the following detailed descriptions of the invention when read in conjunction with the accompanying drawings.

DETAILED DESCRIPTION

Exemplary embodiments of the present invention will be explained in detail below with reference to the accompanying drawings.

Figure 1:
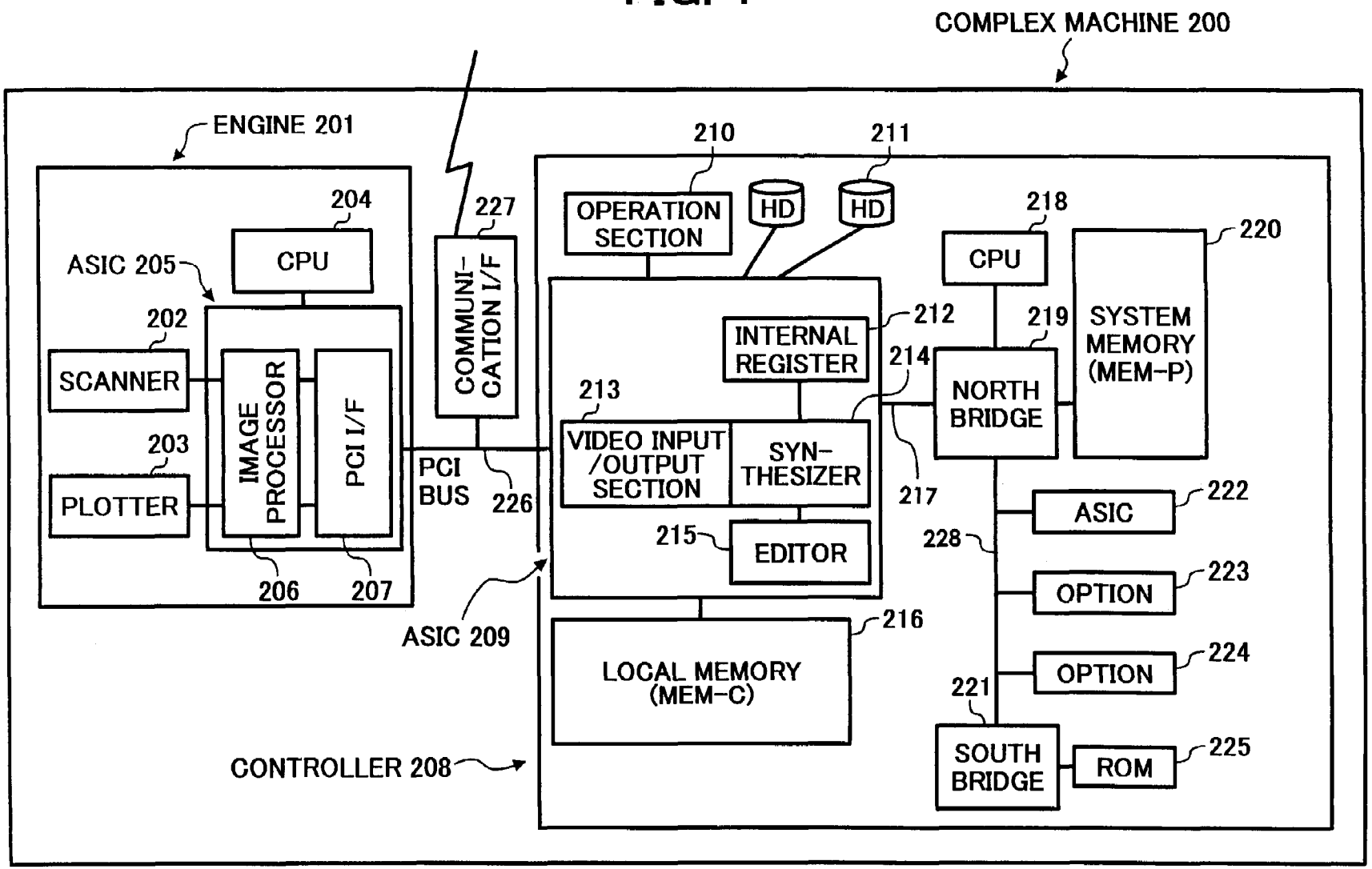
FIG. 1 is a block diagram of an image forming apparatus according to a first embodiment of the present invention.

FIG. 1 is a block diagram of a complex machine 200, being one example of an image forming apparatus according to a first embodiment of the present invention. The complex machine 200 includes an engine 201 and a controller 208, and these are connected to each other by a peripheral component interconnect bus (hereinafter, "PCI bus") 226. A communication interface (hereinafter, "communication I/F") 227 is connected to the PCI bus 226.

The engine 201 has a function for forming an image onto a sheet of paper, for example, reading an image of an original document as image data and correcting the image data. The engine 201 also includes a scanner 202, a plotter 203, a central processing unit (hereinafter, "CPU") 204, and an application specific integrated circuit (hereinafter, "ASIC") 205.

The scanner 202 is an image reader, such as an image scanner or a reading mechanism in a facsimile system, which reads an image of the original document. The plotter 203 is a unit having a mechanism for inputting image data from the scanner 202 or a hard disk 211 to form an image onto a sheet of paper, and printing the image, and the unit is, for example, a monochrome plotter forming a monochrome image or a one drum color plotter forming a color image. The CPU 204 controls the parts, such as an engine of the scanner 202 or the plotter 203, which performs mechanical operation of the engine 201 via the ASIC 205, according to a program stored in a read only memory (hereinafter, "ROM") (not shown). The ASIC 205 includes an image processor 206 that performs image processing such as error diffusion and gamma transformation, and a PCI interface (hereinafter, PCI I/F) 207, which is an interface with the PCI bus 226.

The controller 208 controls the complex machine 200, and includes an ASIC 209, an operation section 210, a hard disk (hereinafter, "HD") drive (hereinafter, "HDD") 211, a local memory (MEM-C) 216, and a CPU 218. The controller 208 further has a chip set (a group of LSI for controlling data transfer) including a north bridge (hereinafter, "NB") 219, a system memory (MEM-P) 220, a south bridge (hereinafter, "SB") 221, an ASIC 222, OPTIONs 223 and 224, and a ROM 225. The ASIC 209 and the north bridge 219 are connected with an accelerated graphics port (hereinafter, "AGP") 217.

The ASIC 209 is an IC for image processing application having a hardware element for image processing, and has a function of a bridge that connects between the AGP 217, the PCI bus 226, the HDD 211 and the local memory (MEM-C) 216. The ASIC 209 includes an internal register 212, a video input/output section 213, a synthesizer 214, and an editor 215. The internal register 212 stores data used when the CPU 218 executes a processing program, and for example, stores delay information described later. The internal register 212 also stores information input from the operation section 210, setting information of the video input/output section 213, the synthesizer 214, and the editor 215. The video input/output section 213 performs input and output of image data to and from the engine 201 via the PCI bus 226, and is connected to the synthesizer 214. The synthesizer 214 synthesizes a plurality of image data to form one image data, and outputs the synthesized image data to the video input/output section 213. The editor 215 processes the image data to edit.

The operation section 210 accepts an input from the user and displays various information. The operation section 210 includes an input device such as mechanical keys and touch panel keys, and a display such as a liquid crystal display (hereinafter, "LCD"). The input device has, for example, ten keys, a start key for starting the copying operation, and a stop key for stopping the copying operation. The display displays, for example, information input from the input device, the operation condition, and time.

The HDD 211 stores image data, programs, font data, and forms. An optical disk may be used instead of the HDD 211. The local memory (MEM-C) 216 is used as an image buffer for copying and a code buffer. The AGP 217 is a bus interface for a graphic accelerator card for accelerating the graphic processing, which accesses the system memory directly at high throughput, to achieve speed-up of the graphic accelerator card. The AGP 217 is originally used for displaying a three-dimensional image on a display smoothly, but in the complex machine 200, the AGP 217 connects the NB 219 to the ASIC 209.

The CPU 218 issues a command to the CPU 204 in the engine 201, according to the program stored in the ROM 225, and controls the operation of the controller 208 as well as the engine 201, to perform control of the complex machine 200. The CPU 218 is connected to the ASIC 209 via the NB 219, which is a part of the chip set. If the CPU 218 and the ASIC 209 are connected to each other via the PCI bus 226, the performance decreases. Therefore, the function of the AGP 217 is expanded and used for the connection.

The NB 219 connects the CPU 218 to the system memory 220, the SB 221, and the AGP 217, and is used as, for example, a drawing memory. The SB 221 connects the NB 219 to the ROM 225, PCI devices, and peripheral devices (not shown) via the PCI bus 228. The OPTIONs 223 and 224 are slots for connecting the PCI devices and peripheral devices as an option.

The NB 219 and the SB 221 are connected with the PCI bus 228. The communication I/F 227 is a two-way high-speed serial communication interface that transfers image signals (e.g., print data) and control signals to the other copying machines, and for example, includes an interface according to the standard of IEEE (the Institute of Electrical and Electronic Engineers) 1394. The communication I/P 227 is connected to the PCI bus 226.

In this complex machine 200, since the communication I/F 227 is connected to the PCI bus 226, image data can be transferred to the local memory 216 more quickly, as compared with an instance when the communication I/F 227 is connected to the PCI bus 226 to which the OPTIONs 223 and 224 are connected.

Figure 2:
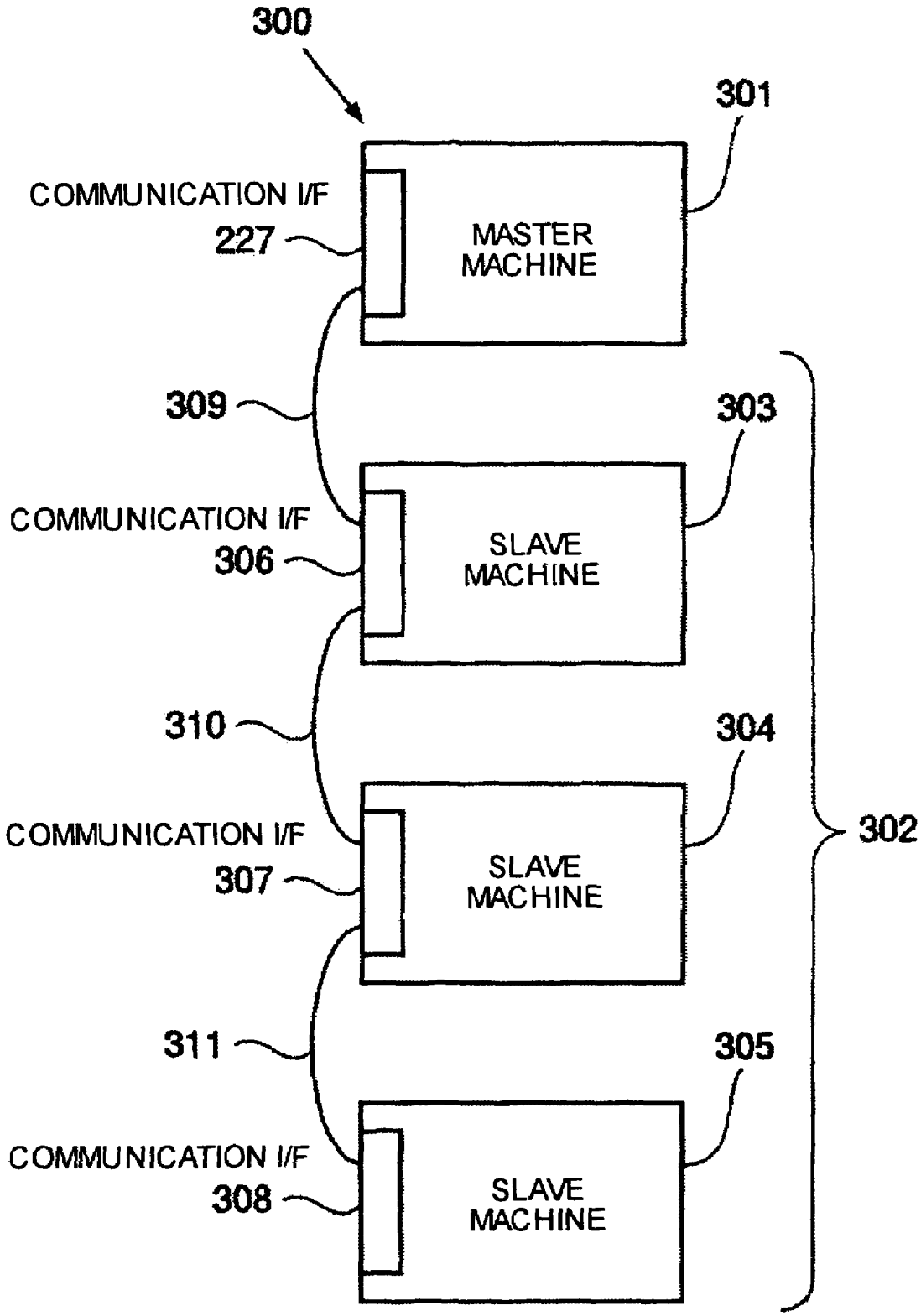
FIG. 2 is a block diagram of the image forming system according to the first embodiment.

FIG. 2 is a block diagram illustrating the configuration of an image forming system 300 corresponding to the complex machine 200. The image forming system 300 includes an image forming apparatus set as a master machine 301 and a slave machine group 302 consisting of a plurality of (three in the figure) image forming apparatus set as slave machines 303, 304, and 305. The master machine 301 and three slave machines 303, 304, and 305 constituting the slave machine group 302 form one image forming apparatus group, and are connected to each other via a communication line in a daisy chain.

The master machine 301 is a complex machine having the same configuration as that of the complex machine 200. The slave machine 303 constituting the slave machine group 302 is connected to the communication PP 227 of the master machine 301 via a communication cable 309, being the communication line. The slave machines 303, 304, and 305 are respectively the complex machines having the same configuration as that of the complex machine 200, and each has two ports for connecting to the other complex machine. The respective communication interfaces 306, 307, and 308 have respectively a communication function equivalent to the communication I/F 227. For example, these are interfaces according to the standard of the IEEE 1394, like the communication I/F 227. The master machine 301 and the slave machine 303, the slave machine 303 and the slave machine 304, and the slave machine 304 and the slave machine 305 are respectively connected via communication cables 309, 310, and 311.

As in this image forming system 300, if the communication interfaces 227, 306, 307 and 308 are composed of the interface according to the standard of IEEE 1394, it is possible to form the image forming system 300 by connecting the respective complex machines in the daisy chain.

Therefore, in the master machine 301 and the slave machine 304, it is possible to exchange data signals and control signals through the slave machine 303. Further, the slave machines 304 and 305 can perform data communication with each other, without the master machine 301.

In the illustrated image forming system 300, four complex machines are connected, but the number of the complex machines to be connected is not limited to four in the image forming system 300 according to the present invention.

Figure 3A:
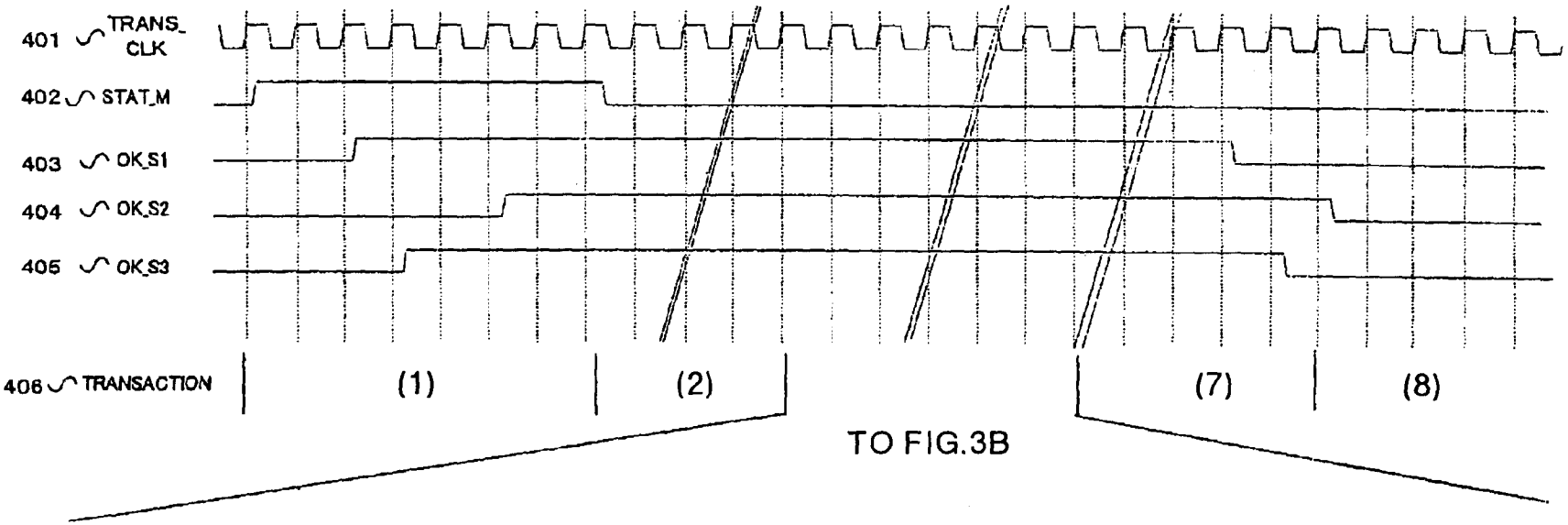
FIGS. 3A and 3B are a timing chart for data transferred between a master machine and a slave machine group constituting the image forming system according to the first embodiment.
Figure 3B:
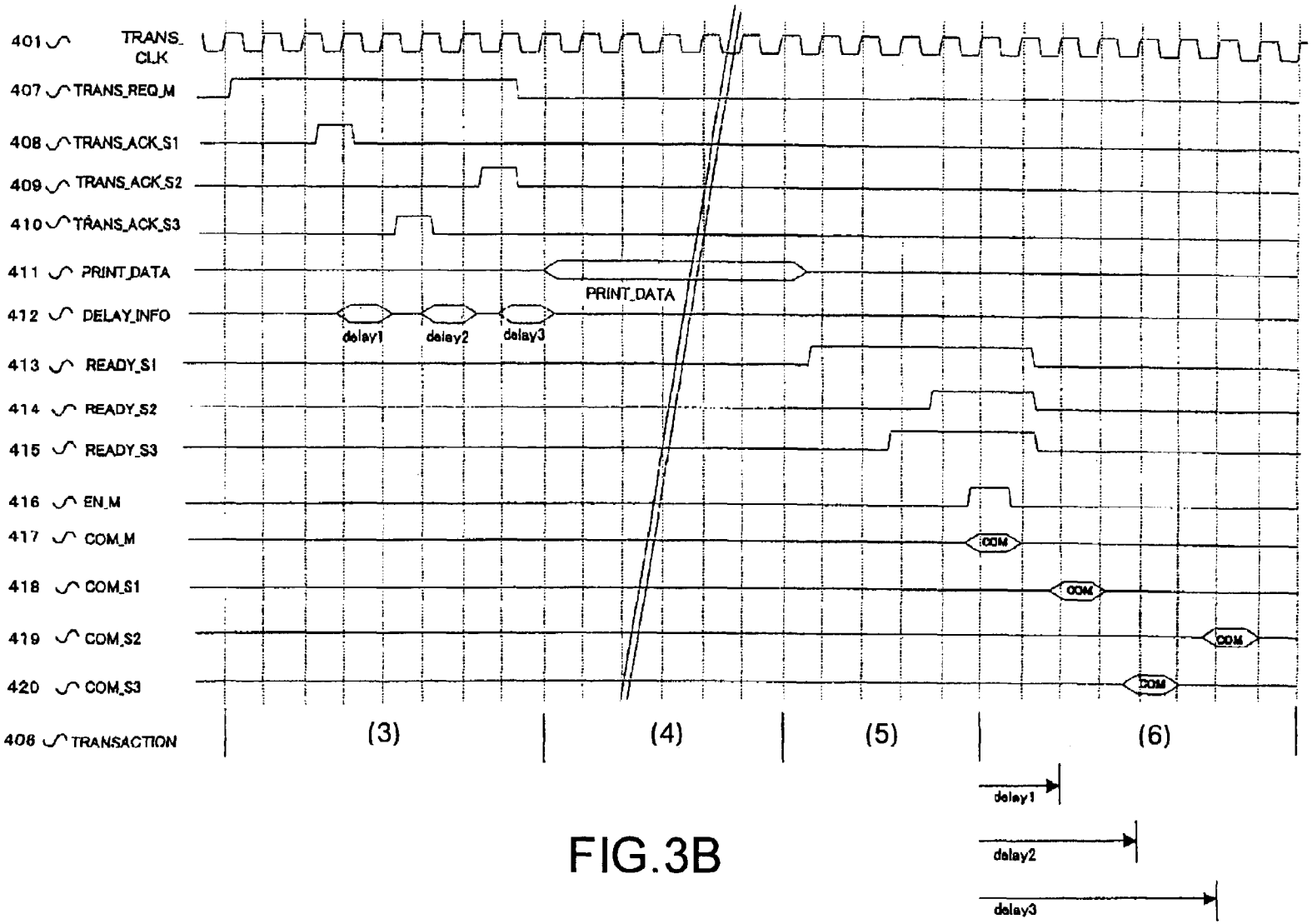
Figure 4:
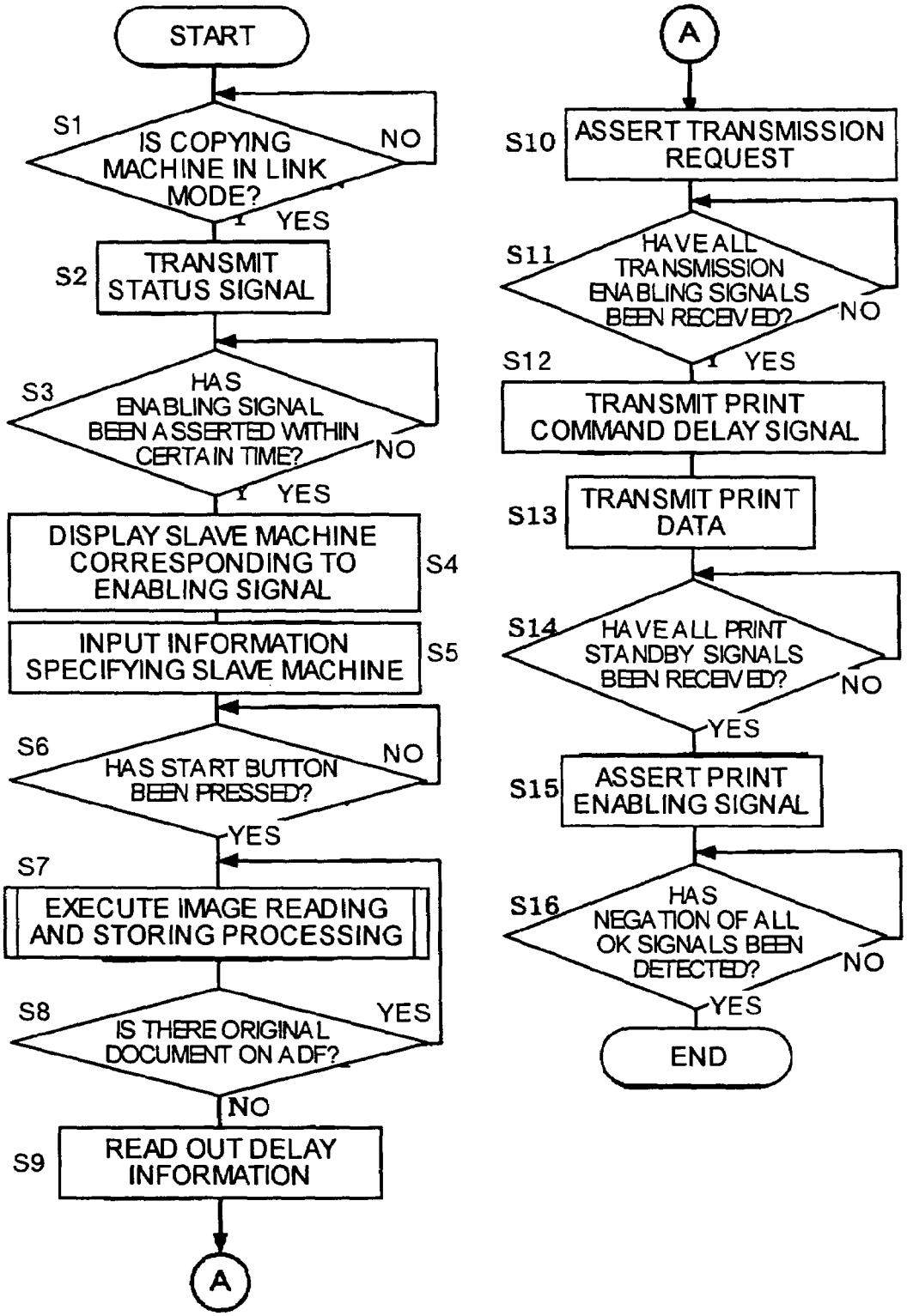
FIG. 4 is a flowchart of operation procedure when the master machine executes operation relating to the image forming system according to the first embodiment.
Figure 5:
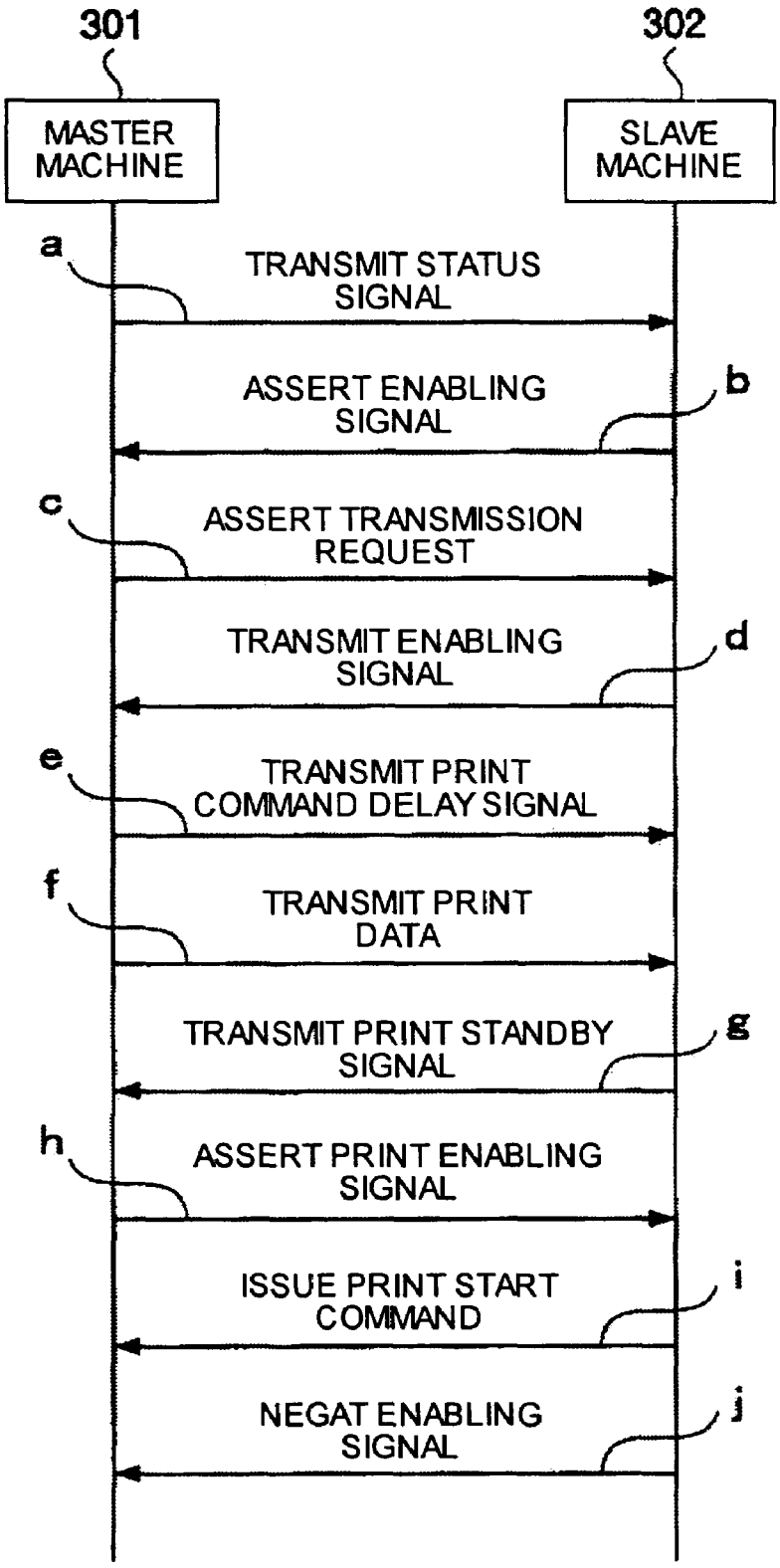
FIG. 5 is an illustration of the procedure for transferring data between the master machine and the slave machine group, when the image forming system is operating.

The operation of the complex machine 200 having such a configuration and the operation contents of the image forming system 300 will be explained below. FIG. 3A is a timing chart for data transferred between the master machine 301 and the slave machine group 302 constituting the image forming system 300. FIG. 3B is a timing chart of the main part in FIG. 3B in an enlarged scale. FIG. 4 is a flowchart of the operation procedure when the master machine 301 executes the operation relating to the image forming system 300, and FIG. 5 is an illustration of the procedure for transferring data between the master machine 301 and the slave machine group 302, when the image forming system 300 is operating. In FIGS. 3A and 3B, lapse of time is partly omitted by inserting slash. Further, a period from (3) to (6) shown in FIG. 3B corresponds to a period between (2) and (7) shown in FIG. 3A.

As shown in FIGS. 3A and 3B, the data transferred between the master machine 301 and the slave machine group 302 is output, synchronously with a communication clock (TRANS_CLK) 401. The communication clock 401 is a clock signal obtained by multiplication of a system clock (not shown) by a multiplier (not shown), in the CPU 218 of the master machine 301. In the explanation of FIGS. 3A and 3B and hereunder, a signal attached with "_M" at the end stands for a signal from the master machine 301 to the slave machine group 302. Further, signals attached with "_S1", "_S2", and "_S3" stand for signals from the slave machines 303, 304, and 305 to the master machine 301, respectively.

The image forming system 300 operates as described below according to the procedure shown in FIGS. 4 and 5. First, a user sets an original document on an automatic document feeder (hereinafter, "ADF"), in the master machine 301, and operates the operation section 210 to display a mode setting screen on a display screen thereof. The user sets the output mode as well as the number of sheets to be copied and output (number of copies), referring to the mode setting screen. In the setting of the output mode, either one of a single output mode and a link output mode can be selected and set. The "single output mode" is a mode in which the image data of the document read by the ADF is formed in an image only by the master machine 301, and when this mode is set, the operation explained below is not executed. The "link output mode" is a mode in which the image data of the document read by the scanner 202, while operating the ADF, is transmitted from the master machine 301 to the slave machine group 302, so that the respective slave machines 303, 304 and 305 constituting the slave machine group 302 perform image forming and output, together with the master machine 301, with the number of copies distributed by the specified number, respectively. When the user sets this link output mode, the operation explained below is executed. In other words, the master machine 301 operates as the master machine, when the user sets the link output mode.

The complex machine 200 operates as a master machine or a slave machine, similar to the master machine 301 or the slave machine 303, 304, or 305. Therefore, when an image forming system similar to the image forming system 300 is configured by connecting a plurality of complex machines 200 with the communication I/F 227 via the communication cables 309, 310, and 311, setting of the link output mode is carried out by using one complex machine 200 thereof, and this complex machine is set as a master machine. In this case, one of the complex machines 200 may be set as the master machine automatically in the following manner. That is, in the state in which setting of the link output mode is not performed by any complex machine 200, when a document is set (placed) on the ADF in order to read the image thereon by the scanner 202, in any one of the complex machines 200, the ADF serving as a detector detects this, and inputs a signal informing the setting of document to the CPU 218. When the CPU 218 receives the signal and detects that the document is set on the ADF, the complex machine 200 becomes the master machine 301, to operate the output timing controller described later. In this manner, in any one of the connected complex machines 200, when the document is set on the ADF, the master machine 301 is automatically determined, and hence setting of the link output mode is not required, thereby simplifying the operation of the user.

In any one of the complex machines 200 (here, the master machine 301 is assumed), at step S1, it waits until the link output mode is set. When the link output mode is set, control proceeds to step S2, where the CPU 218 instructs the communication I/F 227 to execute transmission a of a status signal (STAT_M) 402 from the communication I/F 227 to the slave machine group 302. By executing transmission a of the status signal (STAT_M) 402, the master machine 301 searches a copying machine available as a slave machine for performing image forming.

On the other hand, the slave machines 303, 304, and 305 constituting the slave machine group 302 respectively receive the status signal (STAT_M) 402 via the communication I/Fs 306, 307, and 308. Upon reception of the status signal (STAT_M) 402, the slave machines 303, 304, and 305 respectively judge if image forming is possible, and if image forming is possible, perform assertion b of an enabling signal (OK_S1, OK_S2, OK_S3) 403, 404, 405, respectively. However, if image forming is not possible due to a failure or paper jam, the assertion b of the enabling signal is not executed.

The master machine 301 proceeds with the processing to step S3, to wait until the assertion of the enabling signal (OK_S1, OK_S2, OK_S3) is detected, and when the master machine 301 detects the assertion of any one of the enabling signals, proceeds with the processing to step S4, where the master machine 301 determines a slave machine corresponding to the detected enabling signal, to instruct the operation section 210 to display the slave machine. The user confirms the display on the operation section 210, selects a slave machine to be used for the image forming, and inputs the information specifying the selected slave machine, using the operation section 210. The user also inputs the number of copies for each selected slave machine, to allot the number of copies. The master machine 301 proceeds with the processing to step S5, to input the information input from the operation section 210 to the CPU 218. At this time, the master machine 301 informs the specified slave machine among the slave machine group 302 that it is specified by the master machine 301, as well as the number of copies. This is output at a timing indicated by (1) in TRANSACTION 406 in FIG. 3A.

When the user operates the operation section 210 to press the start button, the CPU 218 proceeds with the processing from step S6 to step S7, to execute image reading of the document and the storage processing of the image data as described below.

That is, the CPU 204 operates according to the instruction from the CPU 218, to operate the scanner 202 in the engine 201, so that the image on the document is read one by one, while transporting the document set on the ADF. The read image data is transferred to the video input/output section 213 in the ASIC 209, through the PCI bus 226, and stored in an first-in first-out type (FIFO) memory (hereinafter, "FIFO") in the video input/output section 213. When having detected storage of the image data in the FIFO, the video input/output section 213 in the ASIC 209 reads out the image data from the FIFO, and writes the image data in a specified address in the local memory 216. When the user instructs synthesis in the mode setting, at a point in time when images for two pages have been read, the synthesizer 214 synthesizes two stored images to one image to generate synthesized image data, stores the synthesized image data in the local memory 216, and outputs the image data to the video input/output section 213. The CPU 218 allows the synthesized image data stored in the local memory 216 to be stored in the HDD 211.

Thereafter, the CPU 218 proceeds to step 58, to judge whether a document is set on the ADF, and if there is a document on the ADF, the CPU 218 returns to step S7 to execute document image reading processing and image data storing processing, and if not, proceeds to a subsequent step S9. In this manner, by executing steps 57 and S8, the document image reading processing and image data storing processing are repeated in the master machine 301, until there is no document set on the ADF. This processing is executed in (2) in TRANSACTION 406 in FIG. 3A.

When reading of all document set sets on the ADF finishes, the CPU 218 operates as an output timing controller, and proceeds with the processing to step 59 to read the delay information from the ROM 225. The delay information is included in a timing control signal for allowing the respective image forming start timing in the image forming operation of the respective image forming apparatus (master machine 301, slave machines 303, 304, and 305) to be different, that is, a print command delay signal, and is the information for delaying the image forming start timing of the slave machines 303, 304, and 305 respectively to shift the timing thereof.

When proceeding to step S10, the CPU 218 executes assertion c of a transmission request (TRANS_REQ_M) 407 with respect to the slave machine group 302 via the communication I/F 227.

The respective slave machines 303, 304, and 305 in the slave machine group 302 then execute reply d of transmission enabling signals (TRANS_ACK_S1, _S2, and _S3), respectively, with respect to the transmission request (TRANS_REQ_M) 407 received from the master machine 301.

The master machine 301 proceeds with the processing of the CPU 218 to step S11, waits until receiving all transmission enabling signals (TRANS_ACK_S1, _S2, and _S3), and when having received all transmission enabling signals, proceeds to step S12, to execute transmission e of a print command delay signal (DELAY INFO) 412 including the delay information at the next clock.

It is the characteristic feature of the present invention that the print command delay signal (DELAY INFO) 412 includes three pieces of delay information (delay 1, delay 2, and delay 3), but in the delay information, the time for delaying the image forming start timing of the respective slave machines 303, 304, and 305 is different from each other. The operation and effect thereby will be described later.

When generating the print command delay signal 412, the CPU 218 allots the delay information with respect to the respective slave machines 303, 304, and 305 in the following manner. The CPU 218 allots the delay information such that the printing start timing comes first in the order of reception of the transmission enabling signals (TRANS_ACK) 408, 409, and 410 (in the order of receiving the transmission enabling signal) with respect to the transmission request (TRANS_REQ) 407 from the master machine 301. In other words, the CPU 218 allows the respective slave machines 303, 304, and 305 to start the image forming operation in the order of reception of the transmission enabling signal. Then, image forming can be performed by giving priority to a slave machine, which is ready to form an image, while postponing a slave machine, which is not ready to form an image (due to a failure or the like), thereby enabling more efficient image forming. In FIG. 3B, the transmission enabling signal (TRANS_ACK_S1) 408 of the slave machine 303 is output first, the transmission enabling signal (TRANS_ACK_S3) 410 of the slave machine 305 is output next, and the transmission enabling signal (TRANS_ACK_S2) 409 of the slave machine 304 is output next. Therefore, the delay information delay 1, delay 2, and delay 3 are transmitted to the slave machines 303, 305, and 304, respectively.

On the other hand, when having received the delay information delay 1, delay 2, and delay 3 included in the print command delay signal (DELAY INFO) 412 via the communication I/Fs 306, 308, and 307, respectively, the slave machines 303, 305, and 304 inputs the delay information to the ASIC 209 via the AGP 217, and sets and stores the information in the internal register 212 in the CPU 218. These are executed in (3) in TRANSACTION 406 shown in FIG. 3B. Thereafter, the slave machines 303, 305, and 304 respectively refer to the delay information set in the internal register 212 by the CPU 218, and counts the time corresponding to the delay information by the internal counter, to delay the command issuing timing thereafter.

Subsequently, the master machine 301 proceeds with the processing of the CPU 218 to step S13, to execute transmission f of print data (PRINT DATA) 411 to the slave machine group 302 via the communication I/F 227.

The slave machines 303, 304, and 305 receive the print data (PRINT DATA) 411 via the communication I/Fs 306, 307, and 308, and store the received print data (PRINT DATA) 411 in the respective HDD 211, according to the respective instruction from the CPU 218. These are executed in (4) in TRANSACTION 406 shown in FIG. 3B. When having stored the print data (PRINT DATA) 411 in the respective HDD 211 and being ready to print data, the slave machines 303, 304, and 305 executes transmission g of print standby signals (READY_S1, S2, and S3) 413, 414, and 415 with respect to the master machine 301. These are executed in (5) in TRANSACTION 406 shown in FIG. 3B.

On the other hand, the master machine 301 proceeds with the processing of the CPU 218 to step S14, to wait until the print standby signals from all slave machines 303, 304, and 305 are received. When having received all these signals, the master machine 301 proceeds to step 515, to execute assertion h of a print enabling signal (EN_M) 416 and print start command (COM_M) 417.

When the slave machines 303, 304, and 305 detect the assertion h of the print enabling signal (EN_M) 416, the respective CPUs 218 delay the time corresponding to the delay information set in the internal register of the respective CPUs 218 from the assertion h of the print enabling signal (EN_M) 416 (after the time course set in the internal counter), and issue print start commands (COM_S1, _S2, and _S3) 418, 419, and 420. At this time, the slave machines 303, 304, and 305 execute the issuance i of the print start commands (COM_S1, _S2, and _S3) 418, 419, and 420, by delaying the time corresponding to delay 1, delay 3, and delay 2. These are executed in (6) in TRANSACTION 406 shown in FIG. 3B.

After having issued the print start commands (COM_S1, _S2, and _S3) 418, 419, and 420, the print processing is executed in the following manner in the respective slave machines 303, 304, and 305. In other words, the ASIC 209 in each of the slave machines reads out the print data from the HDD 211, upon reception of the print start command (COM_S1, _S2, and _S3) 418, 419, or 420, and outputs the command to the FIFO in the video input/output section 213, via the local memory 216 in the slave machine. The engine in each of the slave machines accesses the FIFO in the video input/output section 213 to read the print data, and inputs the print data to the plotter 203 to form an image on a sheet of paper (to conduct printing). After completion of printing, the respective slave machines 303, 304, and 305 execute negation j of enabling signals (OK_S1, OK_S2, OK_S3) 403, 404, 405, respectively. (This is executed in (7) in TRANSACTION 406).

On the other hand, the master machine 301 monitors the print operation in the whole image forming system by the CPU 218. At step S16, when having detected finish of the own print operation, and negation j of all enabling signals (OK_S1, OK_S2, OK_S3) 403, 404, 405 by the respective slave machines 303, 304, and 305, the master machine 301 terminates the operation under the link output mode ((8) in TRANSACTION 406).

In the complex machine 200 and the image forming system 300, since the output timing controller is provided in the master machine 301, the printing start timing of the respective slave machines 303, 304, and 305 is shifted so as to be different from each other. The operation and effect thereof will be explained with reference to FIGS. 6A and 6B.

Figure 6A:
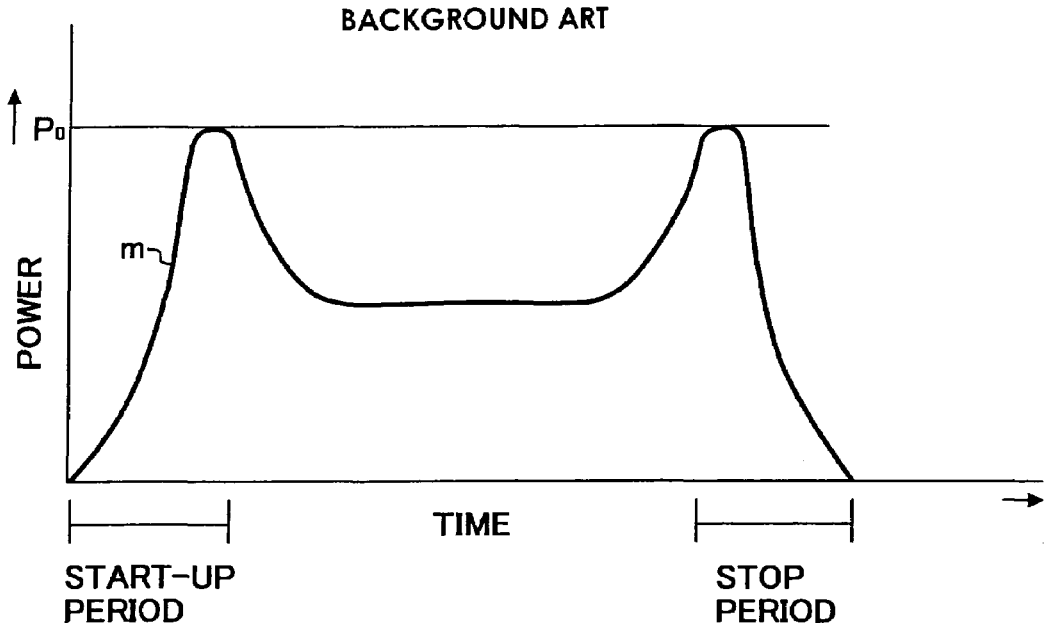
FIGS. 6A and 6B are graphs indicating changes in power consumption in a conventional image forming system, and in the image forming system according to the present invention, respectively.

FIG. 6A is a graph indicating changes in power consumption in a conventional image forming system. In the conventional image forming system, since the print commands are issued almost simultaneously, the drive portions in the engines of the connected complex machines start operation at the same time. Therefore, a curve indicating a rise m in power consumption is steep, and a large power peak $P_0$ appears. Further, at the time of finishing printing, large power is required to stop the drive portions, and hence a large power peak $P_0$ appears.

Figure 6B:
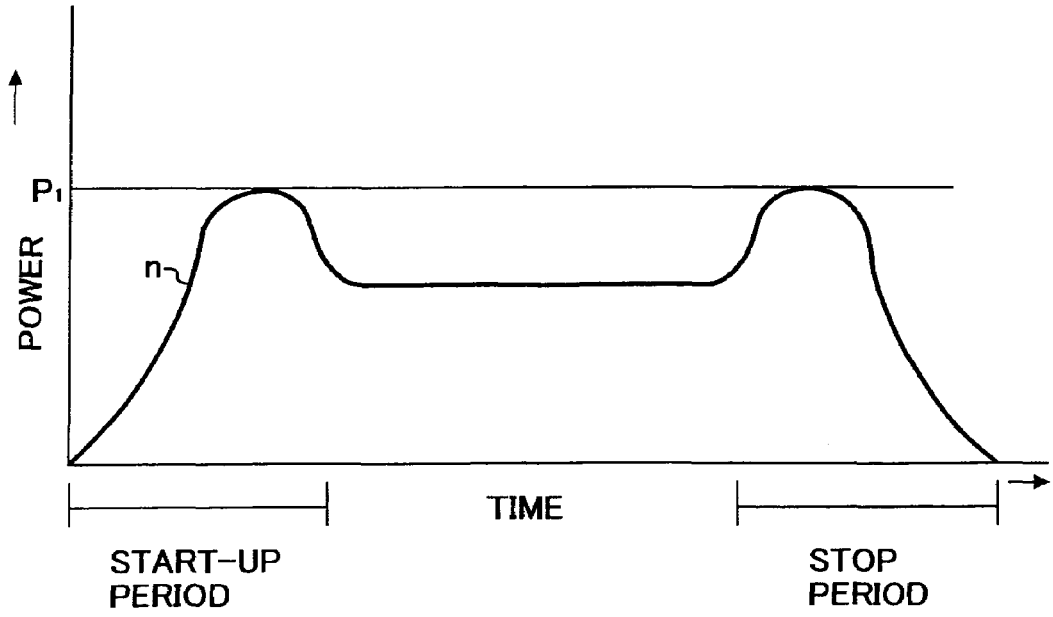

On the other hand, in the image forming apparatus and the image forming system constituted of the image forming apparatus according to the present invention, since the output timing controller in the master machine controls the image forming operation by the respective slave machines, so that the timing for issuing the print start command by the respective slave machines is shifted from each other, the timing for starting drive of the drive portion in the engine in each slave machine is shifted (is different) from each other. Therefore, the timing at which the peak appears in the power consumption is shifted in the respective slave machines, to distribute the overall power consumption. As shown in FIG. 6B, a curve indicating a rise n in power consumption is gradual as compared with that in FIG. 6A, and the peak in the power consumption falls as $P_1$ ($P_0>P_1$). The same applies to the case of finishing printing. According to the present invention, offices where the complex machine 200 or the image forming system 300 formed of the complex machine 200 is introduced are not largely affected in the aspect of power consumption.

Further, by shifting the timing for issuing the printing start commands, the image forming start timing in the engine (the output timing by the plotter 203) is shifted. Since the influence of delay due to the shift of the print command is very small, as seen from the whole period of time required for printing, the productivity in printing performed by the whole system does not drop.

Since the master machine controls the image forming start timing of the respective slave machines, the output timing can be easily controlled in the whole system.

Figure 7A:
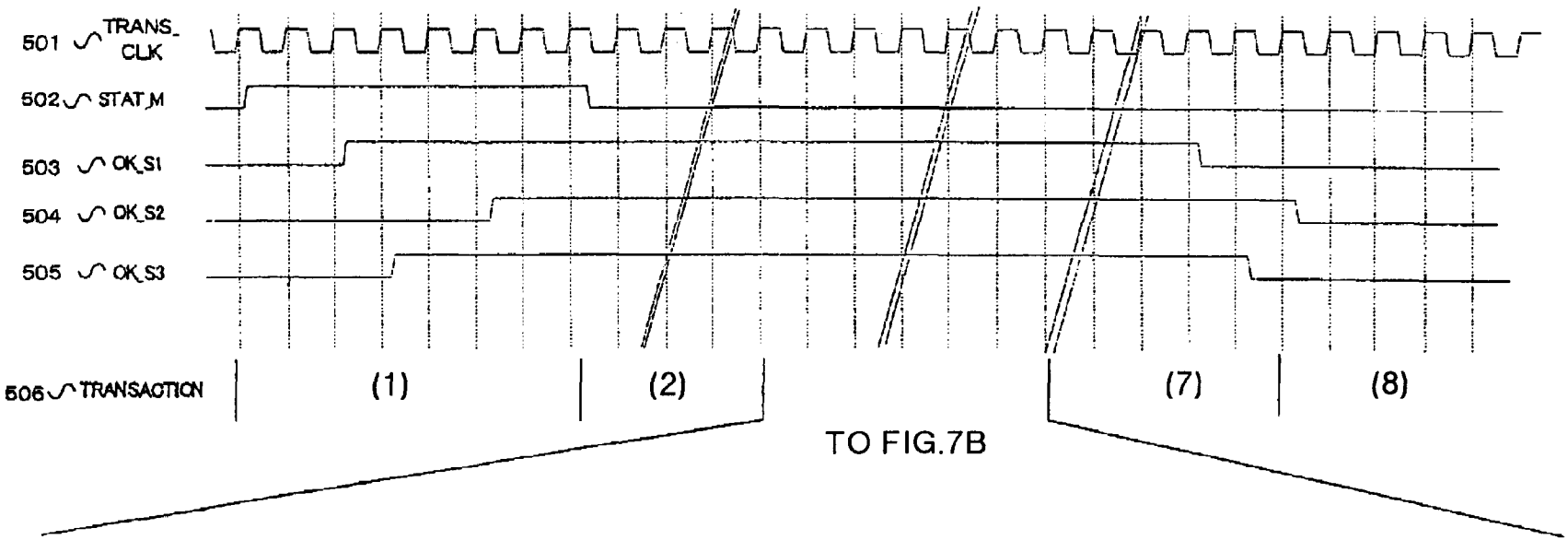
FIGS. 7A and 7B is another timing chart for data transferred between the master machine and the slave machine group constituting the image forming system according to a second embodiment.

In a second embodiment that will be explained below, since an image forming system similar to the image forming system 300 is formed of a complex machine 200 the same as that of the first embodiment, explanation for the complex machine 200 and the image forming system 300 is omitted. In this second embodiment, however, the operation of the image forming system 300 is different from that of the first embodiment. However, it is the same as in the first embodiment that the data transferred between the master machine 301 and the slave machine group 302 is output synchronously with the communication clock (TRANS_CLK) 501, and the same notation is used for signals exchanged between the master machine 301 and the slave machine group 302 (see FIGS. 7A and 7B).

Figure 8:
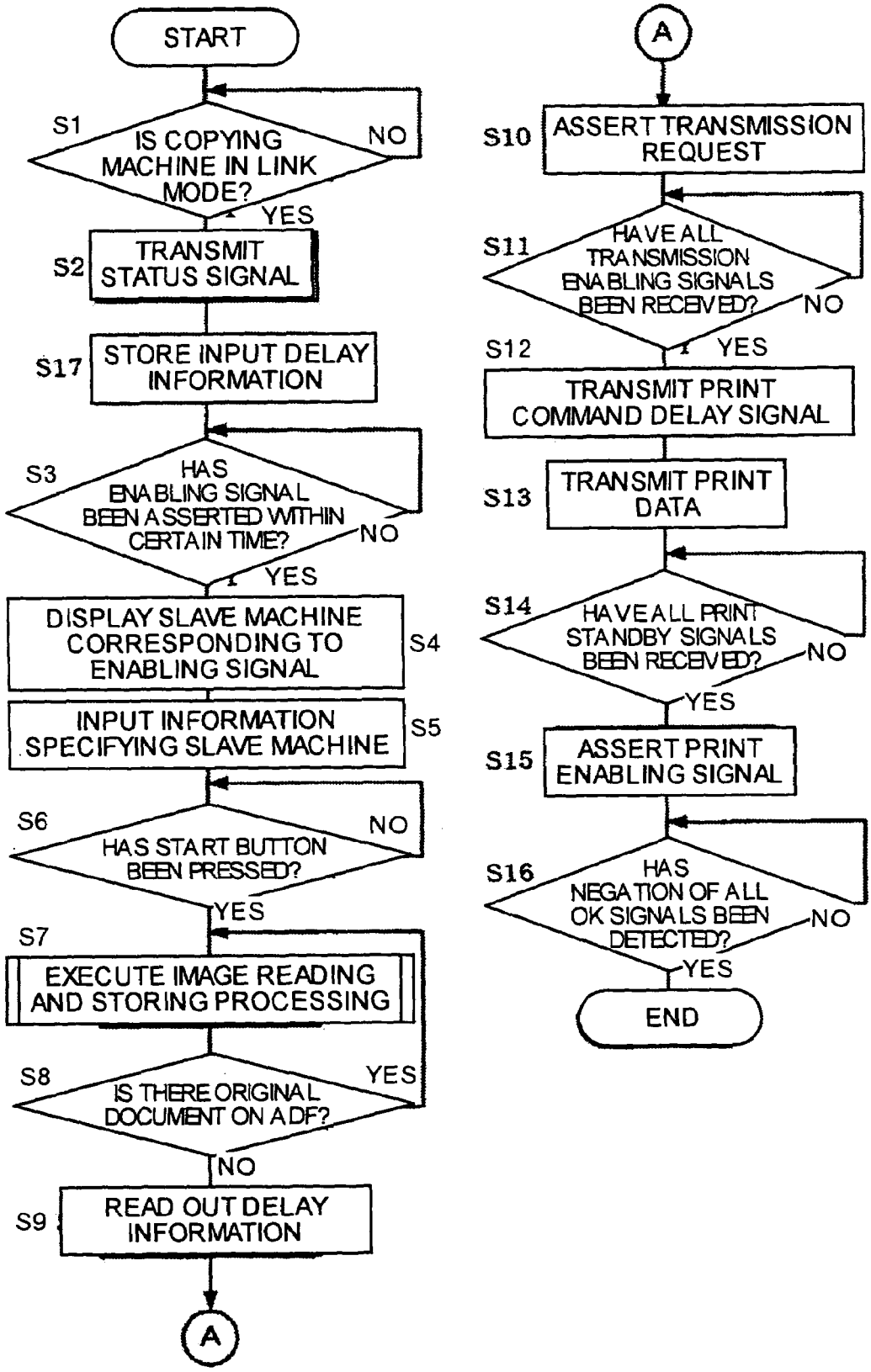
FIG. 8 is another flowchart of operation procedure when the master machine executes operation relating to the image forming system according to the second embodiment.

The image forming system 300 operates as described below, according to the procedure shown in FIG. 8. First, a user sets an original document on the ADF in the master machine 301, and operates the operation section 210 to display a mode setting screen on the display screen thereof. The user sets the output mode as well as the number of sheets to be copied and output (number of copies), referring to the mode setting screen. In the setting of the output mode, either one of a single output mode and a link output mode can be selected and set, as in the first embodiment.

In any one of the complex machines 200 (here, the master machine 301 is assumed), at step S1, it waits until the link output mode is set. When the link output mode is set, control proceeds to step S2, where the CPU 218 instructs the communication I/F 227 to execute transmission a of a status signal (STAT_M) 502 from the communication I/F 227 to the slave machine group 302. By executing transmission a of the status signal (STAT_M) 502, the master machine 301 searches a copying machine available as a slave machine for performing image forming.

At this time, following to the setting of the output mode on the mode setting screen, the user can operate the operation section 210 to input the delay information for the slave machines 303, 304, and 305. Upon reception of user input, the CPU 218 proceeds with processing to step 17, to store the input information in the internal register 212 in the ASIC 209. In this manner, the user can optionally set the delay information for the slave machines 303, 304, and 305.

On the other hand, the slave machines 303, 304, and 305 constituting the slave machine group 302 receive the status signal (STAT_M) 502 via the communication I/Fs 306, 307, and 308, respectively. Upon reception of the status signal (STAT_M) 502, the slave machines 303, 304, and 305 respectively judge if image forming is possible, and if image forming is possible, perform assertion b of an enabling signal (OK_S1, OK_S2, OK_S3) 503, 504, 505, respectively. However, if image forming is not possible due to a failure or paper jam, the assertion b of the enabling signal is not executed.

The master machine 301 proceeds with the processing from step S17 to step S3, to wait until the assertion of the enabling signal (OK_S1, OK_S2, OK_S3) is detected, and when the master machine 301 detects the assertion of any one of the enabling signals, proceeds with the processing to step S4, where the master machine 301 determines a slave machine corresponding to the detected enabling signal, to instruct the operation section 210 to display the slave machine. The user confirms the display on the operation section 210, selects a slave machine to be used for the image forming, and inputs the information specifying the selected slave machine, using the operation section 210. The user also inputs the number of copies for each selected slave machine, to allot the number of copies. The master machine 301 proceeds with the processing to step S5, to input the information input from the operation section 210 to the CPU 218. At this time, the master machine 301 informs the specified slave machine that it is specified by the master machine 301, as well as the number of copies. This is output at a timing indicated by (1) in TRANSACTION 506 shown in FIG. 7A.

When the user operates the operation section 210 to press the start button, the CPU 218 proceeds with the processing from step S6 to step S7, to execute image reading of the document and the storage processing of the image data as described below.

That is, the CPU 204 operates according to the instruction from the CPU 218, to operate the scanner 202 in the engine 201, so that the image on the document is read one by one, while transporting the document set on the ADF. The read image data is transferred to the video input/output section 213 in the ASIC 209, through the PCI bus 226, and stored in the FIFO in the video input/output section 213. When having detected storage of the image data in the FIFO, the video input/output section 213 in the ASIC 209 reads out the image data from the FIFO, and writes the image data in a specified address in the local memory 216. When the user instructs synthesis in the mode setting, at a point in time when images for two pages have been read, the synthesizer 214 synthesizes two stored images to one image to generate synthesized image data, stores the synthesized image data in the local memory 216, and outputs the image data to the video input/output section 213. The CPU 218 allows the synthesized image data stored in the local memory 216 to be stored in the HDD 211.

Thereafter, the CPU 218 proceeds to step S8, to judge whether a document is set on the ADF, and if there is a document on the ADF, the CPU 218 returns to step S7 to execute document image reading processing and image data storing processing, and if not, proceeds to a subsequent step S9. In this manner, by executing steps S7 and S8, the document image reading processing and image data storing processing are repeated in the master machine 301, until there is no document set on the ADF. This processing is executed in (2) in TRANSACTION 506 shown in FIG. 7A.

When reading of all document set on the ADF finishes, the CPU 218 operates as an output timing controller, and proceeds with the processing to step S9 to read the delay information from the ROM 225. The delay information is included in a timing control signal for allowing the respective image forming start timing in the image forming operation of the respective image forming apparatus (master machine 301, slave machines 303, 304, and 305) to be different, that is, a print command delay signal, and is the information for delaying the image forming start timing of the slave machines 303, 304, and 305 respectively to shift the timing thereof.

When proceeding to step S10, the CPU 218 executes assertion c of a transmission request (TRANS_REQ_M) 507 with respect to the slave machine group 302 via the communication I/F 227.

The respective slave machines 303, 304, and 305 in the slave machine group 302 then execute reply d of transmission enabling signals (TRANS_ACK_S1, _S2, and _S3), respectively, with respect to the transmission request (TRANS_REQ_M) 507 received from the master machine 301.

The master machine 301 proceeds with the processing of the CPU 218 to step S11, waits until receiving all transmission enabling signals (TRANS_ACK_S1, _S2, and _S3), and when having received all transmission enabling signals, proceeds to step S12, to execute transmission e of a print command delay signal (DELAY INFO) 512 including the delay information at the next clock.

Also in this embodiment, as in the first embodiment, the print command delay signal (DELAY INFO) 512 includes three delay information (delay 1, delay 2, and delay 3), but in these delay information (delay A, delay B, and delay C), the time for delaying the image forming start timing of the respective slave machines 303, 304, and 305 is different from each other. The operation and effect thereby are as described above.

Also in this embodiment, different from the first embodiment, the print command delay signal has a value specified by the user, that is, a value set at step S17. The print command delay signal including delay A, delay B, or delay C, not the delay 1, delay 2, or delay 3, is transmitted.

Figure 7B:
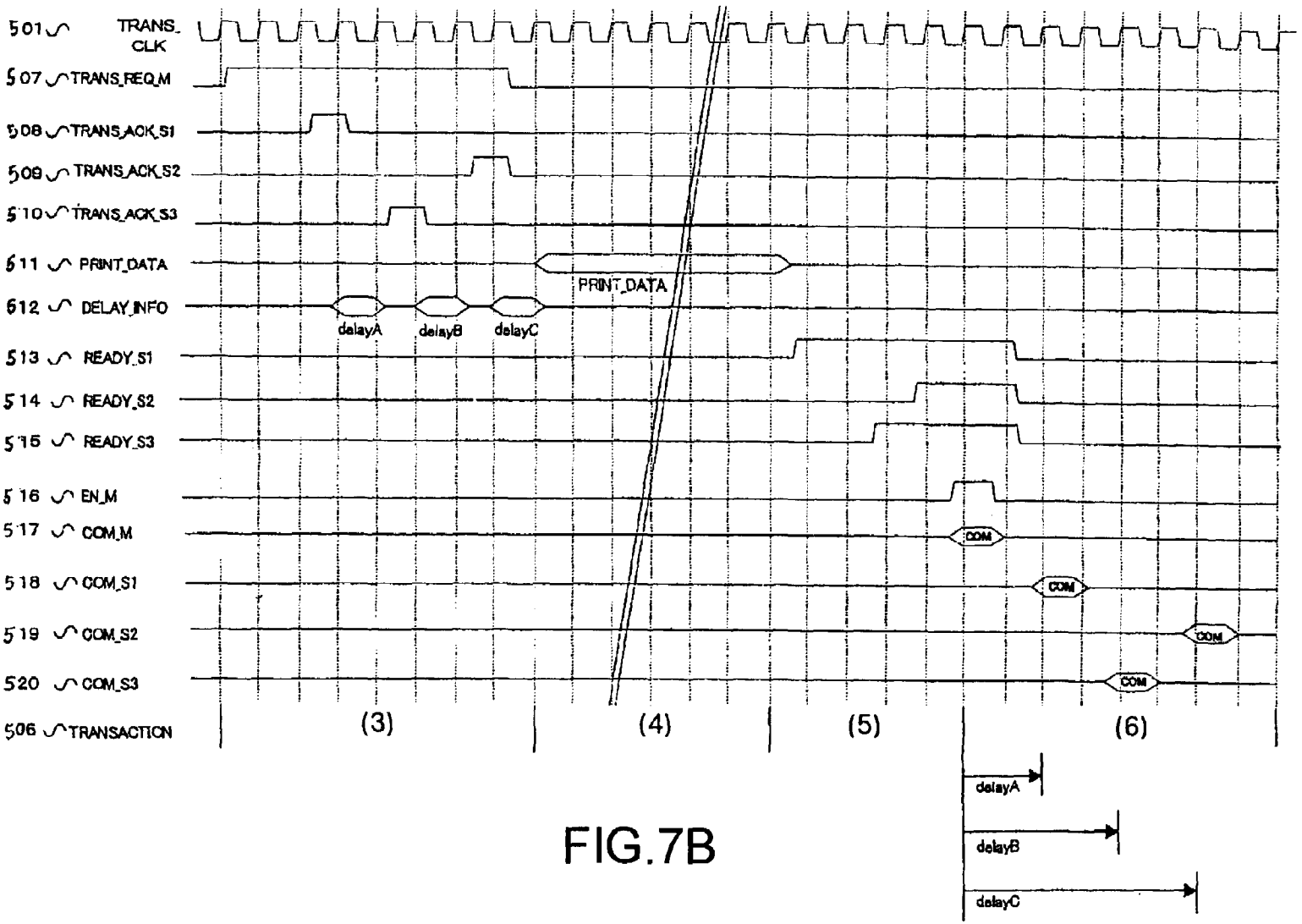

When generating the print command delay signal 512, the CPU 218 allots the delay information with respect to the respective slave machines 303, 304, and 305 in the following manner. The CPU 218 allots the delay information such that the printing start timing comes first in the order of reception of the transmission enabling signals (TRANS_ACK) 508, 509, and 510 (in the order of receiving the transmission enabling signal) with respect to the transmission request (TRANS_REQ) 507 from the master machine 301. In other words, the CPU 218 allows the respective slave machines 303, 304, and 305 to start the image forming operation in the order of reception of the transmission enabling signal. Then, image forming can be performed by giving priority to a slave machine, which is ready to form an image, while postponing a slave machine, which is not ready to form an image (due to a failure or the like), thereby enabling more efficient image forming. In FIG. 7B, the transmission enabling signal (TRANS_ACK_S1) 508 of the slave machine 303 is output first, the transmission enabling signal (TRANS_ACK_S3) 510 of the slave machine 305 is output next, and the transmission enabling signal (TRANS_ACK_S2) 509 of the slave machine 304 is output next. Therefore, the delay information delay A, delay B, and delay C are transmitted to the slave machines 303, 305, and 304, respectively.

On the other hand, when having received the delay information delay A, delay B, and delay C included in the print command delay signal (DELAY INFO) 512 via the communication I/Fs 306, 308, and 307, respectively, the slave machines 303, 305, and 304 inputs the delay information to the ASIC 209 via the AGP 217, and sets and stores the information in the internal register 212 in the CPU 218. These are executed in (3) in TRANSACTION 506 shown in FIG. 7B. Thereafter, the slave machines 303, 305, and 304 respectively refer to the delay information set in the internal register 212 by the CPU 218, and counts the time corresponding to the delay information by the internal counter, to delay the command issuing timing thereafter.

Subsequently, the master machine 301 proceeds with the processing of the CPU 218 to step S13, to execute transmission f of print data (PRINT DATA) 511 to the slave machine group 302 via the communication I/F 227.

The slave machines 303, 304, and 305 receive the print data (PRINT DATA) 511 via the communication I/Fs 306, 307, and 308, and stores the received print data (PRINT DATA) 511 in the respective HDD 211, according to the respective instruction from the CPU 218. These are executed in (4) in TRANSACTION 506 shown in FIG. 7B. When having stored the print data (PRINT DATA) 511 in the respective HDD 211 and being ready to print data, the slave machines 303, 304, and 305 executes transmission g of print standby signals (READY_S1, S2, and S3) 513, 514, and 515 with respect to the master machine 301. These are executed in (5) in TRANSACTION 506 shown in FIG. 7B.

On the other hand, the master machine 301 proceeds with the processing of the CPU 218 to step S14, to wait until the print standby signals from all slave machines 303, 304, and 305 are received. When having received all these signals, the master machine 301 proceeds to step S15, to execute assertion h of a print enabling signal (EN_M) 516 and print start command (COM_M) 517.

When the slave machines 303, 304, and 305 detect the assertion h of the print enabling signal (EN_M) 516, the respective CPUs 218 delay the time corresponding to the delay information set in the internal register of the respective CPUs 218 from the assertion h of the print enabling signal (EN_M) 516 (after the time course set in the internal counter), and issue print start commands (COM_S1, _S2, and _S3) 518, 519, and 520. At this time, the slave machines 303, 304, and 305 execute the issuance i of the print start commands (COM_S1, _S2, and _S3) 518, 519, and 520, by delaying the time corresponding to delay A, delay C, and delay B. These are executed in (6) in TRANSACTION 506 shown in FIG. 7B.

After having issued the print start commands (COM_S1, _S2, and _S3) 518, 519, and 520, the print processing is executed in the following manner in the respective slave machines 303, 304, and 305. In other words, the ASIC 209 in each of the slave machines reads out the print data from the HDD 211, upon reception of the print start command (COM_S1, _S2, and _S3) 518, 519, or 520, and outputs the command to the FIFO in the video input/output section 213, via the local memory 216 in the slave machine. The engine in each of the slave machines accesses the FIFO in the video input/output section 213 to read the print data, and inputs the print data to the plotter 203 to form an image on a sheet of paper (to conduct printing). After completion of printing, the respective slave machines 303, 304, and 305 execute negation j of enabling signals (OK_S1, OK_S2, OK_S3) 503, 504, 505, respectively. (This is executed in (7) in TRANSACTION 506).

Meanwhile, the master machine 301 monitors the print operation in the whole image forming system by the CPU 218. At step S16, when having detected finish of the own print operation, and negation j of all enabling signals (OK_S1, OK_S2, OK_S3) 503, 504, 505 by the respective slave machines 303, 304, and 305, the master machine 301 terminates the operation under the link output mode ((8) in TRANSACTION 506).

In the complex machine 200 and the image forming system 300, since the output timing controller is provided in the master machine 301, the printing start timing of the respective slave machines 303, 304, and 305 is shifted so as to be different from each other. The operation and effect thereof are the same as those in the first embodiment. Further, in this embodiment, a unit which sets the delay information delay A, delay B, and delay C included in the print command delay signal for shifting the printing start timing by the user himself/herself is provided, and the printing start timing is controlled by the delay information set by this unit. As a result, the user can optionally set the printing start timing of each slave machine, corresponding to the operation environment of the image forming system, and the printing capability and the operation environment of the complex machine.

According to the present invention, since the image forming start timing of the image forming apparatus set as slave machines is controlled by the output timing controller in the image forming apparatus set as the master machine, the timing of the peak power consumption in each slave machine is shifted and distributed, thereby reducing the peak in the power consumption.

The present document incorporates by reference the entire contents of Japanese priority document, 2002-238376 filed in Japan on Aug. 19, 2002.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus which is connected to another image forming apparatus via a communication line, the image forming apparatus comprising:

a communication unit that transmits and receives any one of image data and control data for controlling an image forming operation, to and from the another image forming apparatus; and an output timing controller that generates a timing control signal indicating that a start time of an image forming operation is different between the image forming apparatus and the another image forming apparatus.

2. The image forming apparatus according to claim 1, wherein the output timing controller outputs the timing control signal to allow the another image forming apparatus to start an image forming operation at a different time from the image forming apparatus.

3. The image forming apparatus according to claim 2, wherein the timing control signal includes delay information for delaying the image forming operation.

4. The image forming apparatus according to claim 1, further comprising:

an image reader that reads an image of an original document as the image data;

an automatic document feeder that feeds a plurality of original documents placed on an original tray to the image reader one by one;

a detector that detects placement of the original documents on the automatic document feeder; and an operation unit that operates the output timing controller, when the detector detects the placement of the original documents.

5. The image forming apparatus according to claim 2, further comprising:

a setting unit that sets the timing control signal, wherein the output timing controller outputs the timing control signal set by the setting unit.

6. The image forming apparatus according to claim 1, wherein the output timing controller outputs the timing control signal, when receiving a transmission enable signal of the another image forming apparatus.

7. The image forming apparatus according to claim 1, further comprising:

a delay unit that delays the start of an image forming operation based on a delay information received from the communication unit.

8. The image forming apparatus according to claim 7, further comprising:

a delay information storage that stores the delay information.

9. The image forming apparatus according to claim 1, wherein the communication unit is an IEEE1394 interface.

10. An image forming system comprising:

a plurality of image forming apparatuses which are connected to each other via a communication line, wherein each of the image forming apparatuses includes a communication unit that transmits and receives any one of image data and control data for controlling an image forming operation, to and from other image forming apparatuses, and at least one of the image forming apparatuses includes an output timing controller that controls the plurality of image forming apparatuses so that a start time of an image forming operation is different among the plurality of image forming apparatuses.

11. The image forming system according to claim 10, wherein at least one of the image forming apparatuses includes an image reader that reads an image of an original document as the image data;

an automatic document feeder that feeds a plurality of original documents placed on an original tray to the image reader one by one;

a detector that detects placement of the original documents on the automatic document feeder; and an operation unit that operates the output timing controller, when the detector detects the placement of the original documents.

12. The image forming system according to claim 10, wherein the at least one of the image forming apparatuses includes a master machine setting unit that sets the at least one of the image forming apparatuses as a master machine that controls the other image forming apparatuses.

13. The image forming system according to claim 12, wherein the at least one of the image forming apparatuses sets the other image forming apparatuses as slave machines, and outputs a timing control signal including delay information for allowing the slave machines to delay the start of an image forming operation.

14. The image forming system according to claim 13, wherein the at least one of the image forming apparatuses includes a setting unit that sets the timing control signal, and the output timing controller outputs the timing control signal set by the setting unit.

15. The image forming system according to claim 13, wherein the at least one of the image forming apparatuses allows the other image forming apparatuses to start an image forming operation in the order of receiving transmission enable signals from the other image forming apparatuses via the communication unit.

16. The image forming system according to claim 13, wherein the other image forming apparatuses delay the start of the image forming operation based on the delay information received from the at least one of image forming apparatuses via the communication unit.

17. The image forming system according to claim 16, wherein the other image forming apparatuses include delay information storage that store the delay information.

18. An image forming operation control method for controlling a plurality of image forming apparatuses which are connected to a communication line, the method comprising:

allowing the plurality of image forming apparatuses to start an image forming operation at a different time among the plurality of image forming apparatuses based on a delay information output to the plurality of image forming apparatuses.

19. The image forming operation control method according to claim 18, further comprising:

setting at least one of the image forming apparatuses as a master machine that controls other image forming apparatuses;

setting the other image forming apparatuses as slave machines; and outputting a timing control signal including the delay information for allowing the slave machines to delay the start of an image forming operation.

20. The image forming operation control method according to claim 19, further comprising:

setting the timing control signal.

* * * * *